US005426279A

United States Patent [19]

Dasgupta

[11] Patent Number: 5,426,279

[45] Date of Patent: Jun. 20, 1995

[54] HEATING RATE REGULATOR

[76] Inventor: Sankar Dasgupta, c/o Electrofuels Manufacturing Co. 9 Hanna Ave., Toronto, Ontario M6K 1W8, Canada

[21] Appl. No.: 78,849

[22] Filed: Jun. 21, 1993

[51] Int. Cl.[6] ..... H05B 1/02

[52] U.S. Cl. ..... 219/505; 338/22 R; 338/22 SD

[58] Field of Search ..... 392/488; 219/505; 338/22 R, 22 SD

[56] References Cited

U.S. PATENT DOCUMENTS 3,556,496 1/1971 Hucke .
4,610,435 9/1986 Pfau et al. .
4,889,483 12/1989 Gentry .
5,146,536 9/1992 Westover ..... 392/488

*Primary Examiner*—Marvin M. Lateef

[57] ABSTRACT

A ceramic heating rate regulator for electrically powered thermal treatment operations is described. The regulator is made of a ceramic mixture containing molybdenum disilicide, which is an electrically conductive substance undergoing crystal structure transformation above 700° C. The regulator comprises an elongated ceramic rod containing high concentration of molybdenum disilicide, the rod is subsequently insulated by a ceramic cylinder which contains silicon nitride and low concentrations of molybdenum disilicide. The regulator when incorporated in the heating circuit of the thermal treatment furnace will itself heat up and thus reduce the size of the heating current flowing in the circuit, as soon as the temperature of the regulator has reached the transformation temperature of molybdenum disilicide. The heating rate regulator is designed to be used in conjunction with conventional temperature controlling devices.

9 Claims, 2 Drawing Sheets

HEATING RATE REGULATOR

FIELD OF THE INVENTION

This invention is related to controlling the temperature of a thermal treatment operation carried out in an electrically powered installation. More particularly, the invention is related to regulating the rate of heating delivered by means of a heater element, to raise the temperature to a value at which the heat treatment is to be controlled and conducted.

Many different materials utilized in modern equipment require specific thermal treatment at carefully controlled temperatures. Such thermal treatment may include recrystallization, zone refinement, vapour phase deposition, phase boundary segregation and the like. Such operations may be very sensitive to overshooting the temperature range in which the operation is best conducted.

In other type of thermal treatments the rate of heating may be very critical. Sudden increase in temperature may lead to cracking or break-up of the solid due to too rapid crystal structure transformation.

In yet other instances local liquid phase formation, surface changes, undesired vaporization and similar uncontrolled transitional phase reactions may result from fast heating rate, even though maintaining the temperature at the desired value once it has been attained, may be controlled adequately by known means.

Most installations which are designed to operate at high temperature are thermally well insulated. The undesired side effect of good heat insulation, from the point of view of heating rate, for obvious reasons, is that the temperature may continue to rise due to the large thermal mass even after the temperature controller has disrupted the power supply to the installation or to the furnace.

Electrically powered thermal treatment installations, such as an electrically powered furnace, utilize heater elements, heating bars, or the heat may be generated by high resistance coils surrounding the space to be heated. In the instance of the above heaters, heat is provided by the voltage applied and by the current passing through the element. For the sake of clarity, heater elements, bars, coils or similar devices which are designed to generate heat by electric resistance means, will be referred to hereinbelow as heater elements.

The above brief set of illustrations indicate that there is a need for a device to control the rate of increase of temperature within a thermal treatment installation, such as an electric furnace. It is usually desirable that the initial heating rate should be fast to save time, but it is also a common requirement that the rate of temperature increase within the furnace be slower in a region of 50°-300° C. below the temperature at which the treatment is designed to be conducted. One of the more convenient methods of controlling the heating rate, is to control and regulate the power applied to the heater element in the period the furnace approaches the temperature of the intended thermal treatment.

In other instances, it may be of importance that the rate of temperature increase be slow in a temperature range in which the particular material is sensitive to thermal shock.

There are known heat rate regulators which usually comprise complex electronic circuitry having numerous electronic components interlinked. An electrical circuit designed to regulate the rate of change of temperature of substances charged to a furnec for treatment, is described, for example, in U.S. Pat. No. 3,556,496, issued to Hucke E. on Jan. 19 1971. During the operation of such complex circuits, the malfunctioning of one component may upset the balance of operation of the complete circuit thus leading to breakdown of the heat rate regulator and resulting in damage to the equipment, or loss of expensive material, or merely a need to repeat the material preparation which may be very time consuming. Moreover, conventional electronic heating rate regulators are usually fairly expensive.

There is a need for a relatively simple and inexpensive heating rate regulator which is made of reliable ceramic materials, and is capable of repeated and reproducible performance.

SUMMARY OF THE INVENTION

There are ceramic substances which are known to be electrical conductors. There are some ceramic substances which conduct electricity to a measurable degree and which also undergo a crystal structure transformation at high temperature, whereby their electrical conductivity decreases, and the substances become more resistive.

A device for regulating the heating rate of an electrically powered heater element in a thermal treatment installation has now been found. The device comprises an elongated member which is made of an intimate mixture incorporating a ceramic substance that is electrically conductive and is also capable of undergoing crystal structure transformation, whereby its electrical conductivity per unit volume decreases subsequent to the transformation. The elongated ceramic member has two end portions which are constructed to be electrically connectable for incorporation into the heating circuit. The device further comprises an insulator for enclosing the elongated member, and a metallic housing for providing support to the elongated ceramic member and the insulator member, and for providing electrical connection to at least one of the end portions of the elongated ceramic member.

In one embodiment of the invention a second metallic housing is provided for the incorporation and connection of the second end portion of the elongated ceramic member into the heating circuit.

In another embodiment of the invention the second end portion of the elongated ceramic member is shaped such that it encloses both the insulator member and the elongated member, and is fitted within the perimeter of the housing. The second embodiment comprises only one metallic housing, which provides electrical connection to both end portions of the elongated ceramic member containing an electrically conductive ceramic substance.

Figure 1:
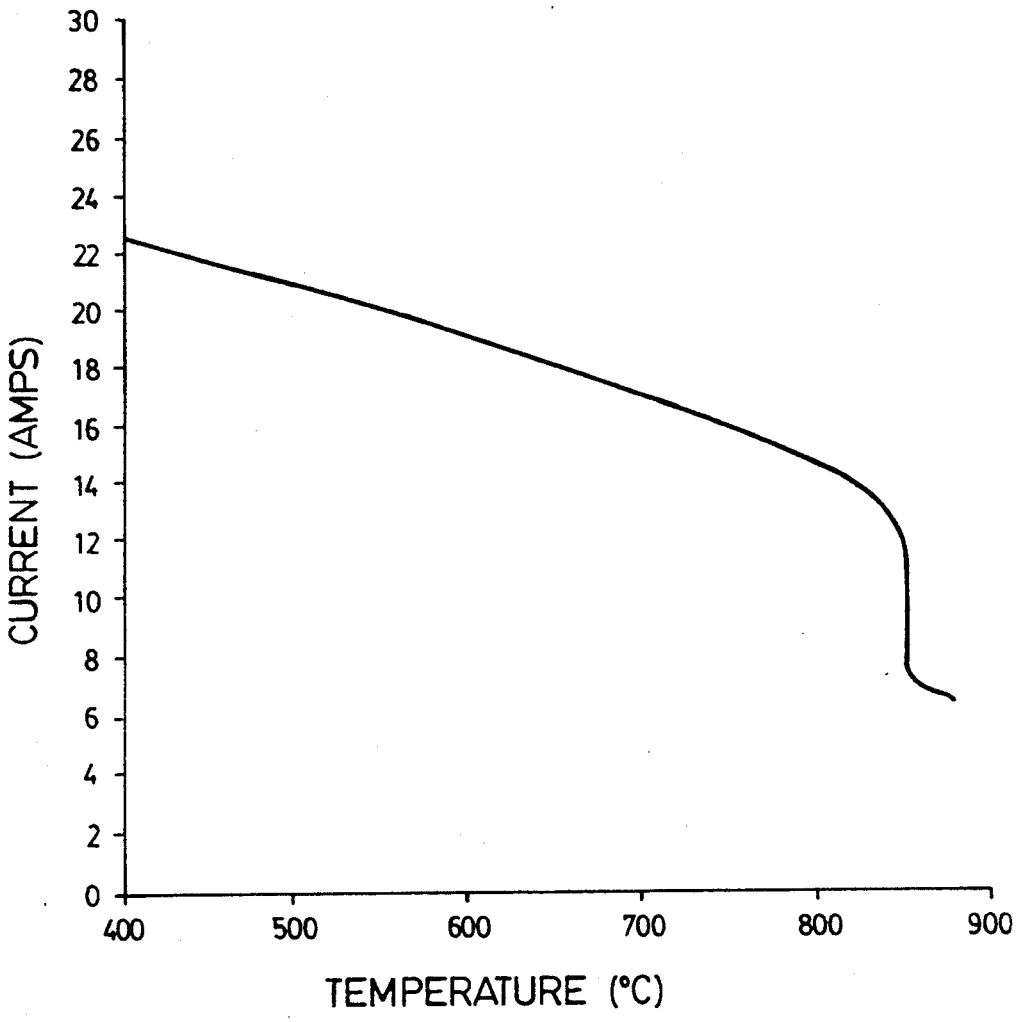
FIG. 1 is a graphical representation of the change in current passing through a ceramic rod containing molybdenum disilicide and silicon nitride, as a function of temperature.

The preferred embodiments of the invention will now be described in detail, illustrated by examples and by reference to the drawings.

DETAILED DESCRIPTION OF THE EMBODIMENTS

As mentioned above, there are known ceramic materials which exhibit notable electrical conductivity. Some of these ceramic materials undergo crystal structure transformation and the changes in atomic distances within the crystal structure may lead to a change in the value of the electrical conductivity of the ceramic material. It is commonly found that if the interatomic distances increase as a result of the transformation then the conductivity diminishes. Since the change in interatomic distances of a specific ceramic compound usually takes place in one predominant crystal plane, dramatic changes in conductivity due to transition from one crystal structure to another, are usually observable only on single crystals of the particular ceramic substance.

It has been found that some electrically conductive ceramic substances, such, as molybdenum disilicide and vanadium trioxide will exhibit distinct conductivity changes even in polycrystalline state, however instead of the sharp change in conductivity observed at the phase transition temperature of the single crystal, molybdenum disilicide $MoSi_2$ and vanadium trioxide $V_2O_3$, show a drop in conductivity of one order of magnitude over about 150° C. range. In other words, the specific resistance of polycrystalline molybdenum disilicide changes from $10^2$ ohm.cm to $10^3$ ohm.cm as the temperature increases from 725° C. to 860° C. A change of similar nature may be observed when heating polycrystalline vanadium trioxide from 200° C. to 400° C.

It is to be noted that polycrystalline molybdenum disilicide in a pure state loses its structural integrity and mechanical strength above its transition temperature, that is it softens above 700° C. It has now been found that the mechanical strength of molybdenum disilicide may be reinforced if this electrically conductive ceramic substance is intimately mixed with an insulator which does not undergo a crystal structure change in the temperature range under discussion. Such insulator substance is silicon nitride. Moreover, it has been Surprisingly found that the gradual decrease in conductivity can be observed even when molybdenum disilicide is intimately mixed with silicon nitride, provided that molybdenum disilicide is present in higher than 33 vol. % in the mixture.

Thus the change in the electrical properties of molybdenum disilicide may be utilized in regulating the electric power applied to the heater elements, thereby adjusting the heating rate of a furnace, if a ceramic body containing molybdenum disilicide is included in the circuit providing power to the heater elements of the furnace. The device incorporating the molybdenum disilicide containing a ceramic body, is connected either in series or parallel, whichever is convenient, with a conventional temperature controlling instrument or device, so that once the furnace or a similar thermal treatment installation has reached the desired temperature, its temperature is controlled in a conventional manner. The present invention is designed to control and regulate merely the rate at which the desired temperature of the furnace or similar thermal treatment installation, is attained.

An elongated ceramic body for use in the device for regulating the heating rate of a heater element, is made of an intimate mixture of molybdenum disilicide and silicon nitride. The cross-sectional configuration of the elongated body is of little importance, but it is most convenient to prepare a ceramic rod of the above mentioned mixture. The length and diameter of the rod depends on the size and power consumption of the furnace in conjunction with which the device is designed to be used.

The concentration of molybdenum disilicide in the mixture depends on the temperature range the device is designed to operate. It has been found that the concentration range is most conveniently between 45 and 75 vol. % of molybdenum disilicide. The $MoSi_2$ concentration, however, may be as low as 34 vol. %, if relatively low conductivity is desired. It was found that below 30 vol. % molybdenum disilicide content, the mixture becomes an insulator.

In order to obtain a coherently sintered elongated ceramic structure containing molybdenum disilicide and silicon nitride, sintering additives such as yttrium trioxide, alumina and aluminum nitride are added to the intimate mixture, in a total amount of less than 6 vol. %. The ceramic rod made of the above mixture conveniently has an end portion at each of its ends, shaped in such a manner that a metallic connector may be fitted to it. The connectors when incorporated in an electrical power circuit will ensure that current flows through the ceramic rod when it is so required.

The ceramic rod is preferably encased in a ceramic insulator substance. The function of the insulator around the ceramic rod is to control the uniformity of the temperature distribution in the ceramic rod as much as it is possible, so that the conductivity within the ceramic rod or similar elongated body made of the mixture, stays uniform. Thus the role of the insulator enclosing the rod is to diminish the effect of external temperature fluctuations, while keeping the end portions accessible to connectors, and thereby allow the device to perform consistently.

Preferably the insulator substance encasing the electrically conductive ceramic rod is of the same chemical composition as the insulator substance forming the intimate mixture. More particularly, in the preferred embodiment the ceramic rod is comprised of molybdenum disilicide and silicon nitride, and the principal ingredient of the insulator enclosing the rod is also silicon nitride.

The ceramic rod and the insulator are preferably supported by a metallic housing. It is usually convenient that the electrical connection to the end portion of the ceramic rod is located centrally.

Figure 2:
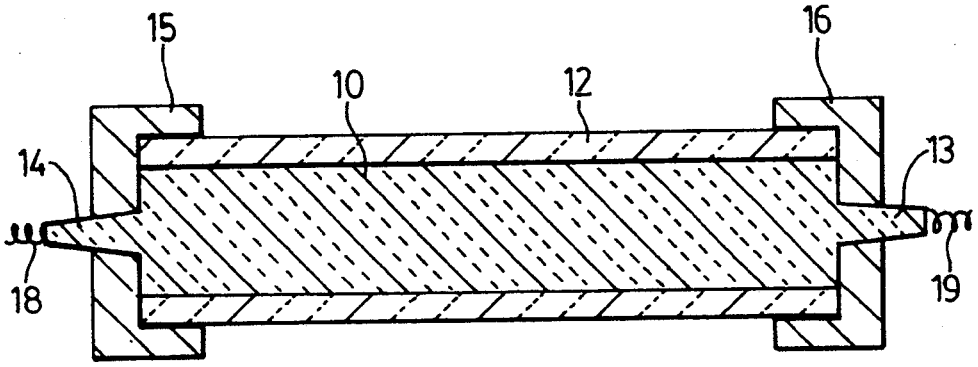
FIG. 2 is a schematic drawing of the longitudinal cross-section of the first embodiment of the invention.

One embodiment of the present invention is schematically shown on FIG. 2. The elongated ceramic rod composed of a mixture of molybdenum disilicide, silicon nitride and sintering additives, subsequent to its having been fired,, is represented by reference numeral 10. Ceramic rod 10, has end portions 13 and 14. Ceramic rod 10, is enclosed by insulator 12, which is shown as a cylinder fitting tightly around the electrically conductive ceramic rod. Both the ceramic rod 10, and the insulator 12, fitting around it are supported at one end by metallic housing 15, and at the other end by metallic housing 16. Electrical leads assisting the incorporation of the respective end portions 13 and 14 of the conductive ceramic rod into the heating circuit are shown schematically by lead wires 18 and 19.

Figure 3:
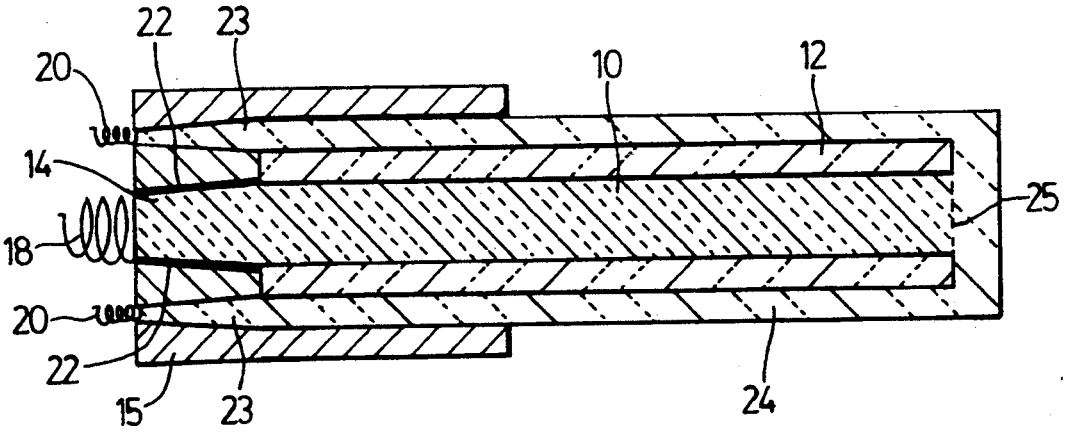
FIG. 3 is a drawing of the schematic longitudinal cross-section of the second embodiment of the present invention.

Another embodiment of the heating rate regulator device incorporating an electrically conductive ceramic rod containing molybdenum disilicide and silicon nitride, is shown on FIG. 3. Like elements of the device are represented by like numerals. One end portion 14, of the ceramic rod 10, is connected to the central connector in metallic housing 15. The insulator fitting around ceramic rod 10, and enclosing it is shown by reference numeral 12. Lead wire 18, is designed to incorporate one end portion of the rod into the electric circuit of the furnace, in a conventional manner.

In the embodiment shown schematically on FIG. 3, the second end portion is formed into a closed end cylinder 24, which is in intimate contact (25) with ceramic rod 10, and tightly fits over cylindrical insulator 12. The open end 23, of the cylindrical end portion 24, fits within the perimeter of housing 15, and is equipped with second lead wire 20. Insulating sleeves 22, shown schematically, ensure that there is no short circuit between end portions 14, and 23, both having been connected to lead wires and supported by housing 15.

The ceramic components of the compact heating rate regulator shown on FIG. 3, consist of two concentric cylinders fitting over and enclosing a ceramic rod. This tightly fitting arrangement makes it desirable, that the thermal expansion coefficients of the ceramic components in contact have values which are close to one another. It was found that the expansion coefficients which are close in value may be best attained when both cylindrical components and the elongated ceramic rod are essentially intimate mixtures of silicon nitride and molybdenum disilicide. The function, that each ceramic component is designed to perform in the heating rate regulator of the present invention, however, requires that they have different electrical properties. The different electrical properties of the ceramic components are achieved by adjusting the respective concentration of molybdenum disilicide in the mixture making up the respective component. Thus it was found that in the embodiment shown on FIG. 3, the insulator cylinder 12, has the preferred composition of silicon nitride containing less than 30 vol. % molybdenum disilicide.

The heating rate regulating function is controlled by the elongated ceramic rod, which preferably has the highest electrical conductivity of the ceramic components of the regulator shown on FIG. 3. It was found that for best results, the mixture making up the ceramic rod is to have molybdenum disilicide in vol. % ranging between 45 and 75.

The tightly fitting cylinder 24, having an open and a closed end, enclosing the insulator 12, and being in intimate contact with the ceramic rod at contact area 25, serves as the second end portion of the ceramic rod, hence for best results it is made of a mixture of silicon nitride containing between 33 and 46 vol. % molybdenum disilicide, or preferably a vol. % range which has a value between the concentrations of the insulator 12, and the ceramic rod 10.

It is to be noted that the concentric cylindrical components and the ceramic rod, each having been made of silicon nitride containing different amounts of molybdenum disilicide and sintering additives, are fitted together in the unfired "green" state and are subsequently fired together to form a sintered unitary body.

EXAMPLE 1

An insulated ceramic rod made according to the above description, and containing 60 vol. % molybdenum disilicide in the rod and 28 vol. % in the insulator cylinder respectively, was subsequently fired. The fired two-part ceramic component was connected to a current measuring device and 8 volt power was applied between its end portions. The temperature of the ceramic rod was measured by conventional means. The current passing through the ceramic conductor was plotted against the temperature of the rod, and the graph obtained is shown on FIG. 1. It can be seen that the current is decreasing in a uniform manner to about 725° C., after which it starts to diminish noticeably, dropping to a significantly lower value at about 850° C. The current decreases at a much slower rate after the temperature of the rod increases above 860° C. It is thus demonstrated that the electrical conductivity of the rod is decreased significantly in the range of 725° C. to 860° C., due to crystal structure transformation.

EXAMPLE 2

A 7 cm long ceramic rod was prepared of a mixture containing 60 vol. % molybdenum disilicide, 2 vol. % each of aluminum nitride, alumina and yttria, the balance being silicon nitride. The diameter of the rod was 0.2 cm. The rod had 1 cm extension at one end which was of 0.08 cm diameter.

Another ceramic mixture of the above components but containing only 28 vol. % of molybdenum disilicide was prepared and an open ended cylinder was compacted of the mixture. The open ended insulator cylinder had such dimensions which allowed it to fit over the first prepared ceramic rod. The wall thickness of the cylinder was 0.12 cm.

A third mixture having the same components as both the rod and the open ended cylinder, but containing molybdenum disilicide in 40 vol. % was prepared. A closed end cylinder was made of this mixture, having dimensions which allowed it to fit over the insulator cylinder. The inner surface of the closed end of the cylinder was such that it ensured intimate contact with the end of the rod opposite the straight, 1 cm long extention portion.

A conventional organic binder was admixed with the mixtures, to assist in compacting. The components fitted together as shown on FIG. 3, were subsequently fired at 1725° C. for 2 hours in argon atmosphere. The unitary body of three ceramic components so obtained, was then fitted into a metallic housing as shown on FIG. 3, so that the end-extension of the rod located centrally served as one connector, and the closed end cylinder formed into the second end portion its open end being fitted within the perimeter of the metallic housing, served as the second connector.

The regulator was incorporated and tested in an electric circuit, additionally incorporating current and temperature measuring means. 8 volts were applied between the electrical leads 13 and 20 of the housing shown schematically on FIG. 3, thereby heating the ceramic rod of the present device. Within 3 minutes the temperature of the regulator rose to over 600° C. Subsequently, the reading of the current in the circuit started to decline, indicating that the electrical resistance of the central rod was increasing. The current dropped rapidly, indicating that the resistance increased substantially around 800° C. The current attained a lower but steady value above 860° C.

It is to be noted, that the above Examples are intended to illustrate that as soon as the transition temperature of the electrically conductive substance is surpassed by the temperature of the central rod, the electrical resistance of the rod is increased and the current is thereby reduced. In common practice, it is apparent, that the length of the time period a particular furnace reaches the temperature of the thermal treatment operation may depend on many variables. More particularly, the length of time in which full electrical power is to be applied to the heater elements may be different in each case. Accordingly, the time in which the heating rate regulator reaches the transition temperature needs to be adjusted to the requirements of the thermal treatment installation and operation. In other words, the electric power applied to the heating rate regulator of the present invention needs to be adjusted to meet the requirements of the furnace, within which the operation is conducted.

It can thus be seen that the heating rate regulator device constructed as described hereinabove, when incorporated in the heating circuit of an electrically operated thermal treatment installation, is capable of regulating the rate at which the thermal treatment temperature is attained.

The present device is relatively easy to connect or replace, has no moving parts which may break down, and has simple and reliable components. The regulator device may be constructed to fit the size and operating power of any electrical furnace design.

Moreover, several heat rate regulators may be incorporated in the same circuit, if that be required.

Although the present invention has been described with reference to the preferred embodiments, it is to be understood that modifications and variations may be resorted to without departing from the spirit and scope of the invention, as those skilled in the art readily understand. Such modifications and variations are considered to be within the purview and scope of the invention and the appended claims.

I claim:

1. A device for regulating the rate of heating, provided by an electrically powered heater element in a thermal treatment operation, comprising:

i) an elongated ceramic member having end portions constructed to be connectable, said ceramic member essentially consisting of an intimate mixture of a polycrystalline electrically conductive ceramic substance capable of undergoing crystal structure transformation in a predetermined temperature range, whereby the electrical conductivity per unit volume of said electrically conductive ceramic substance diminishes with increasing temperature in the range of said crystal structure transformation temperature, said electrically conductive substance being selected from the group consisting of molybdenum disilicide and vanadium trioxide, and an insulator substance having a stable structure in said crystal structure transformation temperature range, said electrically conductive ceramic substance being contained in said intimate mixture in 33–75 vol. %;

ii) an insulator member congruously enclosing said elongated ceramic member, said insulator member comprising said insulator substance contained in said intimate mixture; and iii) a metallic housing, adapted to support said elongated ceramic member and said insulator member, said housing constructed to provide centrally located means to connect electrically one of said connectable end portions of said elongated ceramic member.

2. A device as claimed in claim 1, wherein the temperature range of said crystal structure transformation of said electrically conductive ceramic substance lies between 50°–300° C. below the temperature of the thermal treatment operation.

3. A device as claimed in claim 1, wherein said intimate mixture additionally contains sintering additives.

4. A device as claimed in claim 1, wherein said metallic housing is constructed to additionally support, and provide additional means located within the perimeter of said housing for connecting electrically the other of said connectable end portions of said elongated ceramic member.

5. A device as claimed in claim 4, wherein said other of said connectable end portions of said elongated ceramic member is constructed to form a cylindrical structure congruously enclosing said insulator member, said insulator member congruously enclosing said elongated ceramic member, thereby forming a unitary body of two concentric cylinders congruously enclosing said elongated ceramic member, so that one of said end portions is electrically connected centrally by means provided by said metallic housing and the other of said end portions is electrically connected by means provided within the perimeter of said housing and said end portions are structurally separated by said insulator member congruously enclosing said elongated ceramic member.

6. A device as claimed in claim 5, wherein said unitary body comprising two concentric cylinders and an elongated ceramic member is made of three separate intimate mixtures further comprising an electrically conductive ceramic substance capable of undergoing crystal structure transformation in a predetermined temperature range and an insulator substance, such that the insulator member congruously enclosing said elongated ceramic member is made of a first mixture containing said electrically conductive ceramic substance in less than 30 vol. %, said elongated ceramic member is made of a second mixture containing said electrically conductive ceramic substance in higher than 33 vol. %, and said cylindrical structure congruously enclosing said insulator member, is made of a third mixture containing said electrically conductive ceramic substance in an intermediate vol. % which is more than 33, but less than the vol. % said electrically conductive substance is contained in said elongated ceramic.

7. A device as claimed in claim 1, wherein said other of said connectable end portions of said elongated ceramic member, is supported by a second housing and said second housing is constructed to provide means for connecting electrically said other of said connectable end portions.

8. A device as claimed in claim 1, wherein the electrical conductivity per unit volume of said electrically conductive ceramic substance diminishes by at least one order magnitude above the crystal structure transformation temperature of said electrically conductive ceramic substance.

9. A temperature controlling means for controlling the temperature of a thermal treatment operation, wherein heat is provided by an electrically powered heater element, said controlling means additionally incorporating a device for regulating the rate of heating provided by the heater element, comprising:

i) an elongated ceramic member having end portions constructed to be connectable, said ceramic member essentially consisting of an intimate mixture of a polycrystalline electrically conductive ceramic substance capable of undergoing crystal structure transformation in a predetermined temperature range, whereby the electrical conductivity per unit volume of said electrically conductive ceramic substance diminishes with increasing temperature in the range of said crystal structure transformation temperature, said electrically conductive substance being selected from the group consisting of molybdenum disilicide and vanadium trioxide, and an insulator substance having a stable structure in said crystal structure transformation temperature range, said electrically conductive ceramic substance being contained in said intimate mixture in 33–75 vol. %;

ii) an insulator member congruously enclosing said elongated ceramic member, said insulator member comprising said insulator substance contained in said intimate mixture; and iii) a metallic housing, adapted to support said elongated ceramic member and said insulator member, said housing constructed to provide centrally located means to connect electrically one of said connectable end portions of said elongated ceramic member.

* * * * *